US007182318B1

(12) United States Patent
Crabtree

(10) Patent No.: US 7,182,318 B1
(45) Date of Patent: Feb. 27, 2007

(54) METHOD AND APPARATUS FOR REMOVING AND INSTALLING A DIFFERENTIAL OF A VEHICLE

(76) Inventor: Brandon Crabtree, 5467 Noon Rd., Bellingham, WA (US) 98226

( * ) Notice: Subject to any disclaimer, the term of this patent is extended or adjusted under 35 U.S.C. 154(b) by 272 days.

(21) Appl. No.: 10/808,636

(22) Filed: Mar. 24, 2004

(51) Int. Cl.
*B66D 1/00* (2006.01)

(52) U.S. Cl. ..... 254/324; 212/179; 212/180

(58) Field of Classification Search ..... 212/180, 212/179; 254/324
See application file for complete search history.

(56) References Cited

U.S. PATENT DOCUMENTS

| | | | | | |
|---|---|---|---|---|---|
| 1,343,283 | A | * | 6/1920 | Sanderson | 298/19 V |
| 1,357,279 | A | * | 11/1920 | Denny | 298/19 V |
| 1,698,397 | A | * | 1/1929 | Fow | 254/335 |
| 1,857,579 | A | * | 5/1932 | Armstrong | 384/428 |
| 1,952,238 | A | * | 3/1934 | Dice | 212/324 |
| 2,072,398 | A | * | 3/1937 | Faulk | 254/329 |
| 2,294,757 | A | * | 9/1942 | Larsen et al. | 254/323 |
| 2,522,267 | A | * | 9/1950 | Hardin | 212/337 |
| 2,730,244 | A | * | 1/1956 | Berggren | 212/271 |
| 2,748,459 | A | | 6/1956 | Orr | |
| 2,903,258 | A | | 9/1959 | Jovanovich | |
| 3,012,311 | A | | 12/1961 | Shupe | |
| 3,318,464 | A | * | 5/1967 | Vernor | 212/337 |
| 3,539,152 | A | * | 11/1970 | Harley | 254/323 |
| 3,559,981 | A | | 2/1971 | Abshear | |
| 3,831,773 | A | * | 8/1974 | Haley | 212/342 |
| 4,294,176 | A | * | 10/1981 | Brooks | 105/363 |
| 4,549,722 | A | | 10/1985 | Gagliano | |
| 4,570,905 | A | | 2/1986 | Gerstner | |
| 5,566,999 | A | | 10/1996 | Goettl | |
| 6,122,811 | A | * | 9/2000 | Shirley | 29/281.1 |
| 6,322,061 | B1 | | 11/2001 | Maser et al. | |

* cited by examiner

*Primary Examiner*—Thomas J Brahan
(74) *Attorney, Agent, or Firm*—Michael F. Hughes; Hughes Law Firm, PLLC

(57) ABSTRACT

A hoisting assembly that is adapted to be mounted to the frame of a vehicle where a hoisting device extends an attachment member such as a hook to connect to an engagement location of the differential where the hoisting assembly is positioned substantially vertically above the differential and when the hoisting assembly supports a differential the load is transferred to the frame of the vehicle.

14 Claims, 4 Drawing Sheets

METHOD AND APPARATUS FOR REMOVING AND INSTALLING A DIFFERENTIAL OF A VEHICLE

BACKGROUND OF THE INVENTION a) Field of the Invention

The invention relates to a method and apparatus for removing and installing a differential from and to a vehicle where the differential and a hoisting assembly supporting the differential are supported by the frame of the vehicle.

b) Background Art

The prior art disclosures are primarily directed toward supporting a differential by applying a force to elevate and support the differential where the surrounding ground surface is the primary direct area for support. For example, the following prior art referenced as are discussed herein below.

U.S. Pat. No. 6,322,061 (Maser et al) discloses a "Universal Axle and Differential Carrier Stand". The disclosure shows a wheeled base frame having two upper horizontal support rails 12 to which are mounted vertically aligned support arms 24 which are adjustably mounted by sliding supports 25. At the upper end of these arms are a pair of axle clamp assemblies 30 which fit into the members 24 so that these can be placed at different elevations. FIG. 3 shows the apparatus supporting the differential 70.

U.S. Pat. No. 5,566,999 (Goettl) relates to a particular type of mechanism by which the differential can be lifted. In column 1, under "Background of Invention," beginning on line 36, it is stated that it is a common practice to weld a lifting eye or loop to an exterior of the case of the differential, and this can be used to accept the hook of a hoist. It is indicated that this is done by welding, and this can weaken the case of the differential at that point. The disclosure is directed to the particular type of hoist attaching mechanism, and this comprises upper and lower jaws 20 and 22 which grip the flange of the differential, and there are also various bolt connections.

Other US patents disclose various methods of supporting a differential such as U.S. Pat. No. 4,570,905 (Gerstner) shows a floor jack attachment which is intended to be used as a means to hold and move a differential. U.S. Pat. No. 4,549,722 (Gagliano) shows a floor jack that is intended to be used to support a differential as it is removed. U.S. Pat. No. 3,559,981 (Abshear) shows a wheeled device that is secured to a differential, and used to remove it from the housing.

U.S. Pat. No. 3,012,311 (Shupe) provides yet another differential support intended to be secured to a jack on the floor. U.S. Pat. No. 2,903,258 (Jonanovich) shows a repair stand that may be secured to a floor jack to move the differential about the shop. Finally, U.S. Pat. No. 2,748,459 (Orr) shows a jack attachment intended to support a differential.

SUMMARY OF THE INVENTION

In general the invention relates to a hoisting assembly for removing a differential that is adapted to be mounted on a frame of a vehicle. The vehicle having a differential that is adapted to be attached thereto the hoisting assembly. The hoisting assembly has a central frame having first and second lateral ends and a central area. A hoisting device is adapted to be mounted to the central area of the central frame. The hoisting device comprising an attachment member that is adapted to be mechanically attached to the differential of the vehicle.

The hoisting device is adapted to raise the attachment member vertically and the differential attached thereto and support the differential where the central frame is positioned substantially vertically above the differential.

DETAILED DESCRIPTION OF THE PREFERRED EMBODIMENTS

Figure 1:
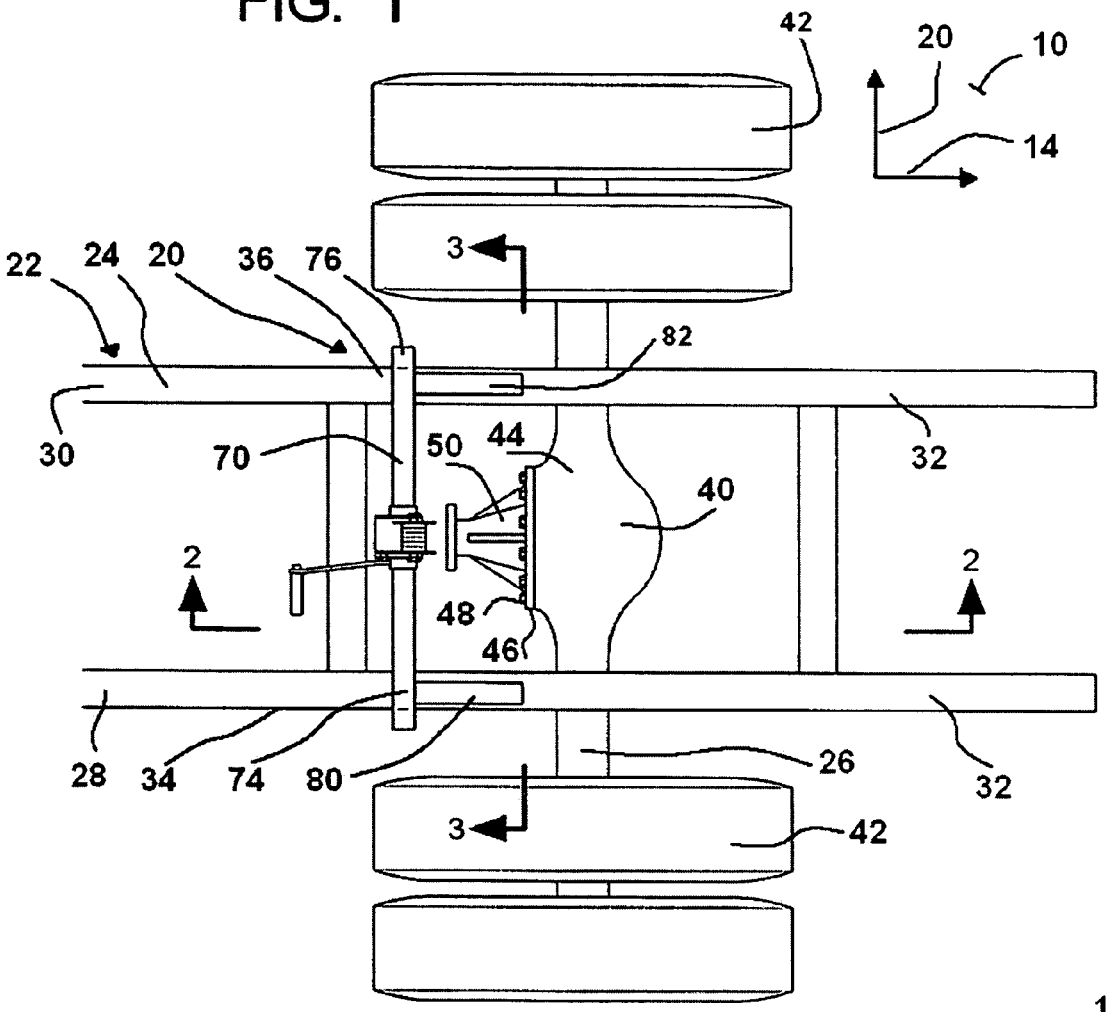
FIG. 1 is a top view of the hoisting assembly in an operating environment where it is positioned on the frame member of a vehicle.
Figure 2:
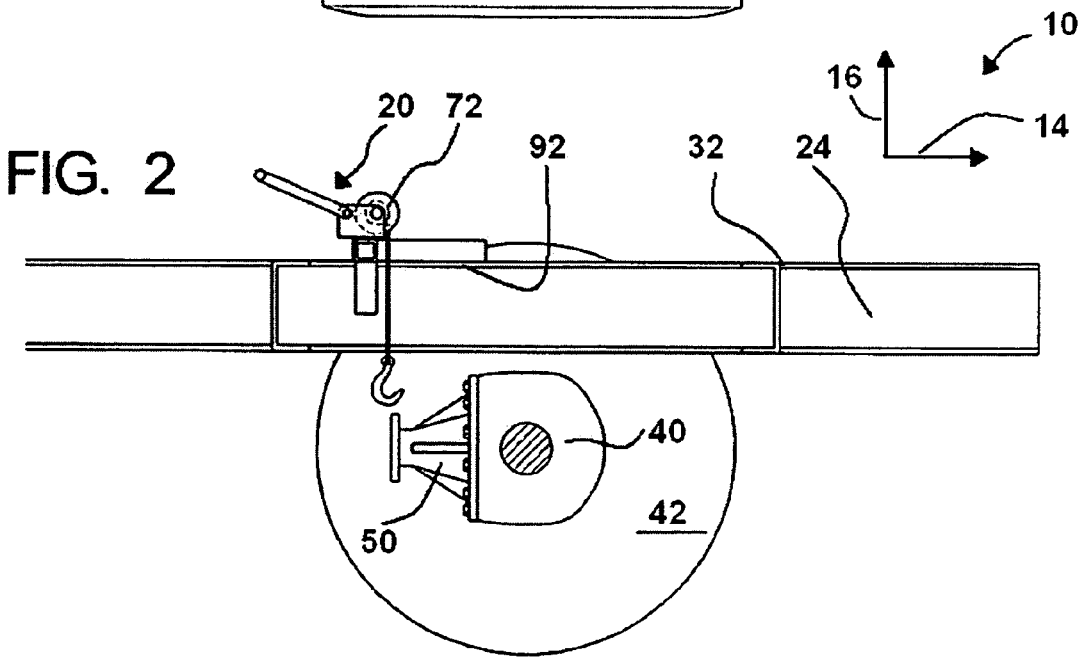
FIG. 2 is a side elevation on view taken along line 2—2 of FIG. 1 and shows the hoisting assembly positioned upon the upper support surface of the frame of the vehicle where the attachment member is positioned in a longitudinally forward location of a differential.

The following is a detailed description of an embodiment of the hoisting assembly 20. The various components of the hoisting assembly are discussed further herein following a description of the general operating environment. To aid the description an axis system is defined where as shown in FIG. 1, the axis system 10 comprises a lateral axis 12 and a longitudinal axis 14. As shown in FIG. 2, the axis system 10 further comprises a vertical axis 16. The various axes are put forth to describe the general relationship of the components and are not intended to limit the apparatus in any specific orientation. Further, the axes denotes a general direction and substantial orthogonal directions with respect to one another.

The general environment of the hoisting assembly 20 is for removal and replacement of a differential and differential housing. As shown in FIG. 1, there is a portion of a vehicle 22. The vehicle 22 such as a truck comprises a frame 24 and axle assembly 26. The frame 24 as a first lateral frame section 28 and a second lateral frame section 30. The frame 24 further comprises an upper surface 32. The frame 24 further has first and second outer vertical surfaces 34 and 36 positioned on the first and second frame sections 28 and 30 respectively and outward surfaces 33 and 35. The axle assembly 26 comprises a central axis member 40 and wheel assemblies 42 positioned in the laterally outward portions of the central axis member 40. The central axis member 40 further has a circular flange region 44 (banjo housing of the truck rear axle) with a plurality of connection locations 46. In one form, the connection locations are a threaded recessed region adapted to engage bolts 48. Normally, a plurality of bolts spaced around the outer circumference area are employed to securely attach the differential 50 thereto.

Figure 4:
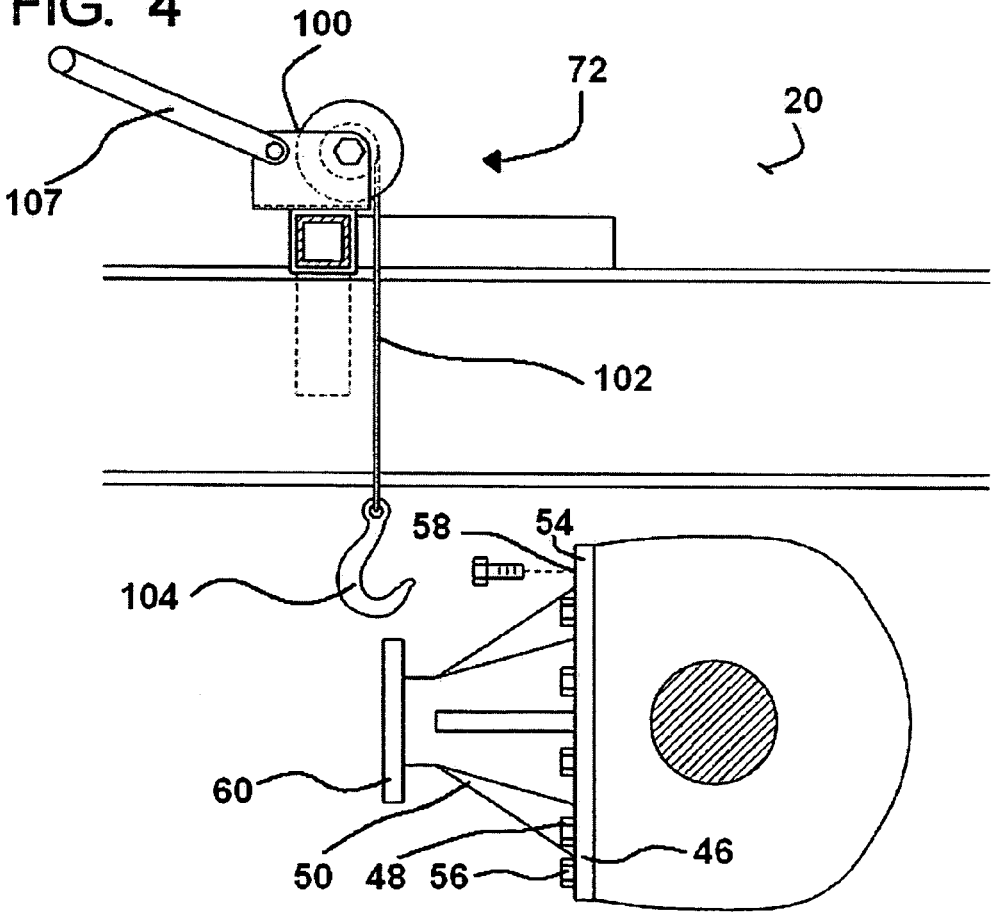
FIG. 4 shows a partial cross sectional view where a bolt is removed at an engagement location and the attachment member is positioned in a longitudinally forward location of the engagement location of the differential.

As shown in FIG. 4, the differential 50 comprises a housing section 52 and a flange region 54. The flange region 54 has a plurality of connection locations 56 that when in a mounted position, correspond in location to the connection locations 46 of the flange region 44 of the axle 40. The connection locations 56 are generally surfaces defining circular openings that are adapted to allow the bolts 48 to extend therethrough and fasten the differential 50 to the axle 40. As described further herein, in one form an engagement location 58 is defined which is one of the connection locations 56 that is preferably that the vertically upper location. The engagement location is adapted to support a vertical force to support the differential 50 and is adapted to engage with the attachment member 104 described further herein.

The differential 50 further comprises a longitudinally forward region having a smaller diameter circular flange 60 which in normal practice a clevis extends therefrom. The clevis is generally coupled to a drive shaft which is not shown in the figures.

Figure 3:
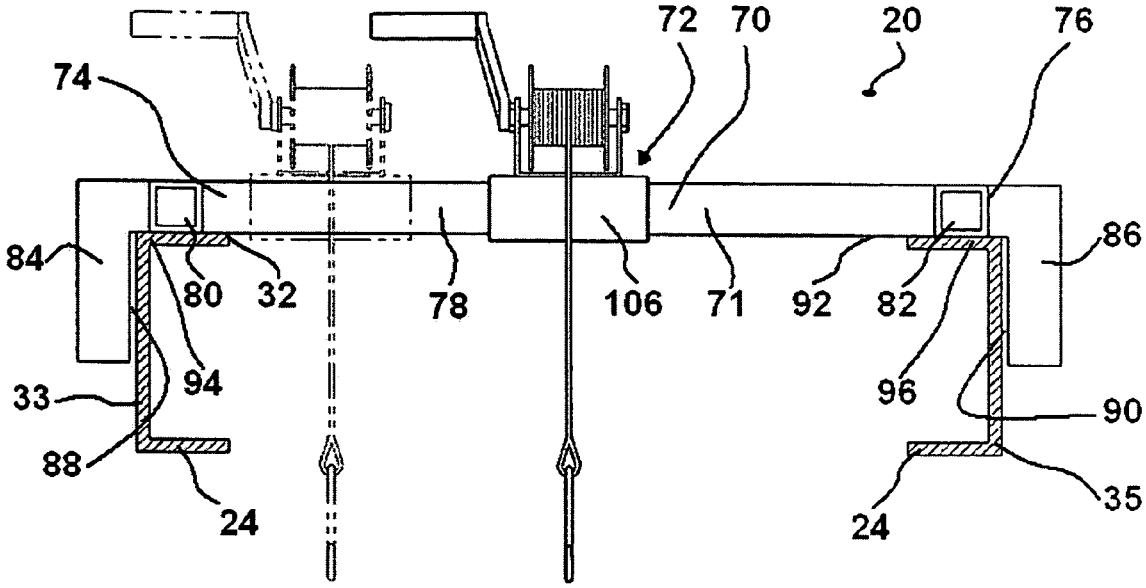
FIG. 3 is a partial sectional elevation view taken along line 3—3 of FIG. 1 and shows how the hoisting device can be repositioned laterally with respect to the central frame of the hoisting assembly.

There will now be detailed discussion of the hoisting assembly 20 with initial reference to FIG. 3. As shown in this figure, the hoisting assembly 20 comprises a central frame 70 and a hoisting device 72. The central frame 70 comprises a first lateral end 74 and a second lateral end 76. The central frame further has a central area 78. In one form, the central frame 70 is constructed from square tubular material such as steel. As shown in FIG. 1, the central frame 70 comprises first and second longitudinally extending members 80 and 82 which are located in the first and second lateral end locations 74 and 76 respectively and a laterally extending member 71. In one form, the longitudinally extending members 80 and 82 are rigidly attached (e.g. welded) to the laterally extending portion of the central frame 70.

In one form, end portions 84 and 86 are positioned in the first and second lateral locations 74 and 76. The end portions 84 and 86 each have lateral inward surfaces 88 and 90 that are adapted to engage the lateral outward surfaces 33 and 35 of the frame 24. The laterally extending member 71 and the longitudinally extended members 80 and 82 collectively provide a lower support surface 92. The lower support surface has a first lateral subregion 94 and a second lateral subregion 96. The lateral subregions 94 and 96 are particularly adapted to engage the upper support surface 32 of the frame 24. The lower support surface 92 further has a perimeter region that is defined as the outer boundaries of the support surface that can support a load and not topple the hoisting assembly 20. It should be further noted that the subregion surfaces 94 and 96 are adapted to engage in the longitudinal direction where the support from the central frame 70 positioned sufficiently broad enough in the horizontal plane to support the action of the hoisting device 72 described further herein.

The hoisting device 72 is attached to the laterally extending member 71 of the central frame 70. As shown in FIG. 3, in one form the hoisting device 72 can be repositioned along the central region 78 of the central frame 70. By repositioning these hoisting device 70 in the lateral direction, this aids in providing a vertical lift and getting around portions of the vehicle that may be in the way when the hoisting assembly 20 is an operation.

As shown in FIG. 4, the hoisting device 72 comprises a power retraction system 100, a cable 102 and an attachment member 104. The power retraction system 100 is adapted to forcefully retract the cable 102. In one form, this is a hand-cranked system employing a hand-crank 107 with conventional internal gearing mechanisms to supply sufficient leverage to draw in the cable 102 around an internal spool. Of course other mechanisms such as an electric motor that would run off the 12-volt supply, a ratcheting device, a removable handle that can be repositioned to reel in the cable 112, or simply a nutlike extension adapted to receive a wrench for applying torque thereto, or any other method of retracting the cable 102 can be employed and are hereby defined under a hoisting device.

The cable 102 in one form is a metallic cable of sufficient strength to support a differential 50 with a factor of safety that is common in the industry. For purposes of definition in this application, a cable is defined as any flexible device adapted to support a load in tension such as a strap made a various materials such as nylon, Kevlar or other types of materials as well as a metallic type of flexible material like woven metal or chains and other flexible tension type members can be employed of various materials such as, polymers, or other devices to support a differential 50 can be employed.

Further, the cable and power retraction system could be in the nature of a linkage system where a linkage having an attachment member attached to one location is employed where a combination of levers give mechanical advantage to support the differential 50 and allow it to be removed or installed into the vehicle 22 in similar manner as the process described further herein. In one form the attachment member is a hooklike device but could further be other methods of connecting member such as a chain or other similar item that is adapted to wraparound a substantial portion of the differential to support it. Further, a connection device can be welded to the differential with a connection member adapted to connect thereto. Further, any other device that is adapted to securely mounted the end portion of the cable 102 to differential can function as the attachment member 104 and is hereby defined as such for the connection member.

The power retraction system is mounted to a housing component 106 (see FIG. 3). In one form, the housing component 106 has an interior surface and cross-sectional open area slightly greater than the exterior surface of the laterally extending member 71. The housing component 106 is adapted to reposition the power retraction system 100 laterally as shown by the hatched lines in FIG. 3. In one form, a locking mechanism can lock the hoisting device 72 to a particular lateral location. However, because there is a sufficient amount of vertical force when the hoisting device 72 is supporting a differential, and normally the upper surface 32 of the frame 24 is substantially in the horizontal plane, (at least substantially level in the lateral direction), the internal friction between the inner surface of the housing component 106 in the outer surface of the laterally extending member 71 is sufficient to prevent the hoisting device 72 from accidentally repositioning laterally in an undesirable and unexpected manner. Further, when the hoisting device 72 is supporting a differential such as that is shown in FIG. 5, the hoisting device 72 and the differential 50 can be repositioned laterally with respect to the central frame member 70 by nudging the hoisting device in a lateral direction with a shove or an impact such as a blow from a rubber mallet.

Figure 5:
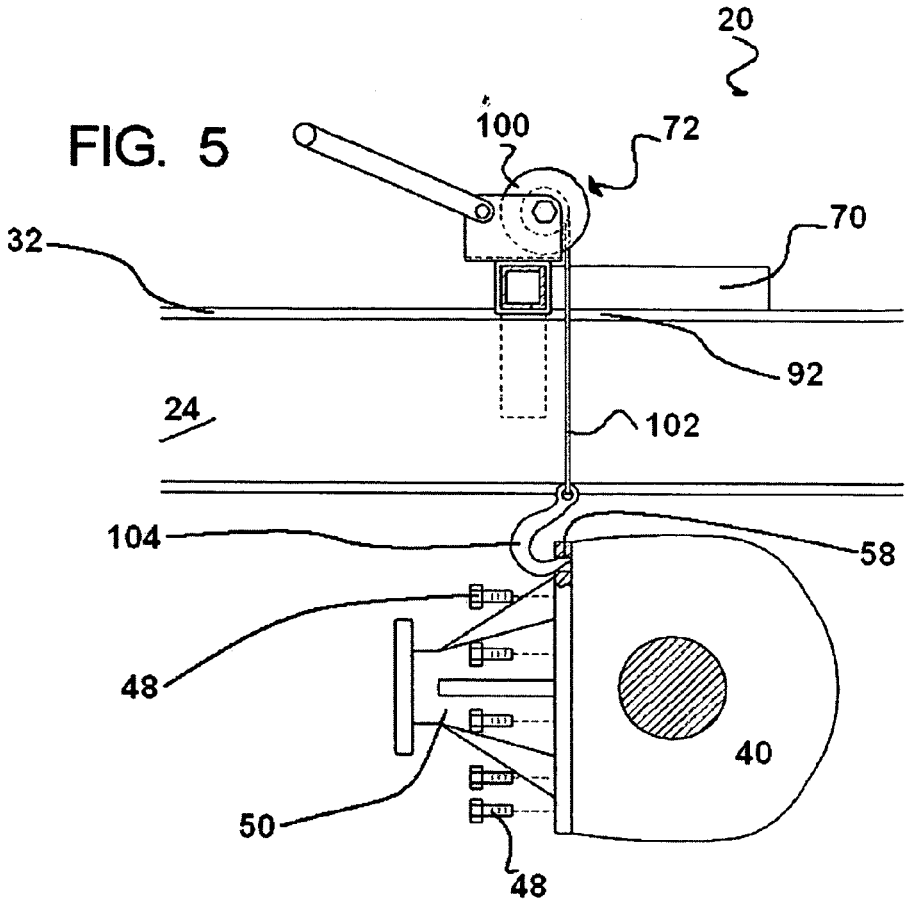
FIG. 5 shows the attachment member operatively connected to the differential at an engagement location.

There will now be discussion of the removal process and method of the differential when employing the hoisting assembly with initial reference to FIG. 5. As shown in this figure, the hoisting assembly 20 is positioned substantially above the differential to be removed 50. The term "positioned substantially above" or "positioned substantially vertically above" is defined as a vertically higher location which may not necessarily be directly above the differential but is merely defined as being positioned at a greater vertical elevation with respect to the differential 50 regardless of the horizontal position. The central frame 70 of the hoisting assembly 20 is positioned on the vehicle frame 24. In one form, the hoisting assembly 20 is positioned on the vehicle frame 24 where the lower support surface 92 of the central frame 70 is positioned upon the upper support surface 32 of the frame 24. Of course other methods of positioning the central frame 70 can be employed to mount the hoisting device 20 onto the frame 24 of the vehicle 22. For example, the interior regions of the C channels that comprise the frame 24 can be used to support the central frame 70 of the hoisting assembly 20 and such methods are herein defined as mounting the hoisting assembly 20 to the frame 24 of the vehicle 22.

When the central frame 70 is mounted to the frame 24, it is held in place by the frictional forces between the surfaces of these frame members. Therefore, the hoisting assembly 20 can be repositioned in the longitudinal direction so the hoisting assembly 20 is substantially above the differential 50 as shown in FIG. 5.

To remove the differential 50, the attachment member 104 is inserted into the engagement location 58. In one form as mentioned above, the attachment member 104 is a hook like device that is attached to the cable 102.

The power retraction system 100 of the hoisting device 72 is adapted to allow free extension of the cable 102 when desired by the operator, can further lock in place at a set length, and be retracted into the housing of the power extractor 100 forcefully (i.e. with sufficient tension to support the weight applied thereto) to generate tension in the cable 102. After the attachment member 104 is secured to the engagement location 58 of the differential 50, the power retraction system 100 is employed and the cable 102 is retracted or tension is applied thereto and a sufficient amount of vertical force is imparted upon the differential to counteract the weight of the same. Then the bolts 48 are removed as shown in FIG. 5 and extracted from the connection locations of the differential 50 and the axle 40.

Figure 6:
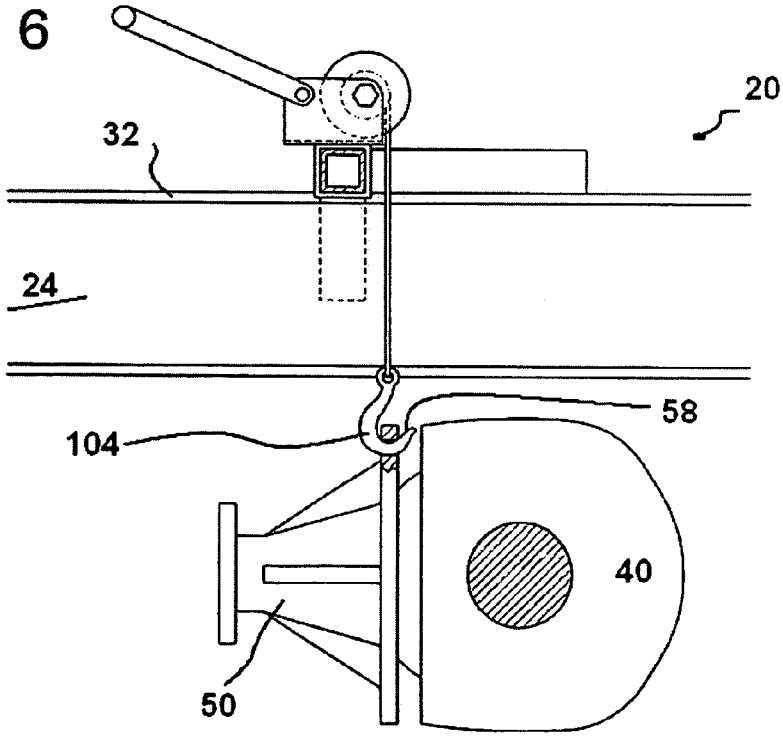
FIG. 6 shows the attachment member fully inserted into the engagement location and the differential is removed from the axle region of the vehicle.

Thereafter as shown in FIG. 6, the differential 50 is fully and totally supported by the hoisting assembly 20. In one form, the attachment member 104 will extend through the open region of the engagement location 58. However, depending upon the size of the attachment member 104 this may or may not occur in practice.

Figure 7:
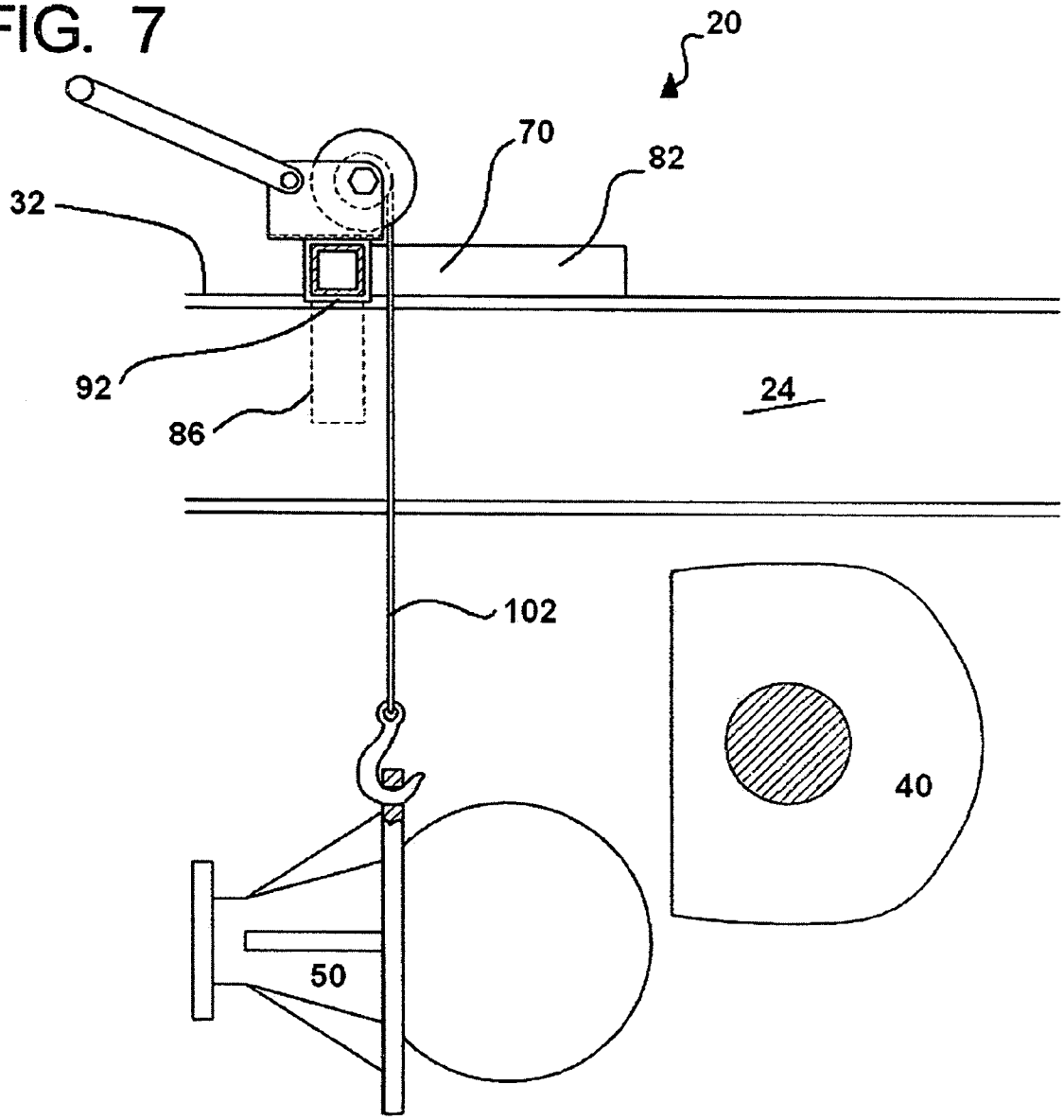
FIG. 7 shows the differential removed from the axle assembly of the vehicle where the hoisting assembly is positioned at a vertical location greater than the vertical location of the differential.

Now referring to FIG. 7, the hoisting device 20 is repositioned longitudinally forward with respect to the axle 40 and the frame 24 of the vehicle. In one form, this is accomplished where the lower support surface 92 of the central frame 70 simply slides upon the upper support surface 32 of the frame 24. Of course, wheel assemblies or other lower friction devices can be employed such as an undercoating or another material can be attached such as a polymer plastic, nylon or the like to the under portions of the frame 70 of the hoisting assembly 20. It has been found that the coefficient of friction between steel surfaces is sufficiently low that the hoisting assembly 20 can be repositioned with respect to the frame and slide thereon even with the weight of a differential 50 attached thereto. As shown in FIG. 7, the longitudinally extending members 80 and 82 (only 82 is shown in the partial cross-sectional view) assist in supporting the differential 50 so the center of gravity of the combination of the differential 50 and the hoisting assembly 20 is between the extreme area support location which is the surfaces of the perimeter region of the hoisting assembly 20 that includes the lower surfaces of the central frame 70 and the longitudinally extending members 80 and 82. Further, as shown in FIG. 7 as a cross-sectionally hatched hidden line, the end portions 84 and 86 (only end portion 86 is shown as a hidden line) help assist in refraining excessive lateral movement of the hoisting assembly 20. This is primarily a safety device where the hoisting assembly will not repositioned laterally where one of the first or second lateral ends 74 or 76 will slide beyond the lateral interior most portion of the frame members whereby toppling the hoisting assembly and the supported differential. Of course this lateral movement can be impeded in a variety of ways, for example as shown in FIG. 3, a vertically downward extending member could be positioned on the interior portion of the frame 24.

A repaired or new differential can be reattached to the axle 40 in a similar manner as the removal process but in the reversal of steps. To attach or install the differential to a vehicle, first the hoisting assembly 20 is positioned substantially vertically above (as also defined supra where the hoisting assembly is positioned at a vertical location greater than the vertical location of the differential irrespective of the horizontal location) and the attachment member 104 is attached to the attachment location of the differential. The hoisting assembly 20 is attached to the frame of the vehicle. In one form, the hoisting assembly rests upon the upper support surface 32 of the frame 24 of the vehicle. The attachment member is operatively connected to the cable 102 which in turn is connected to the hoisting device 72. The hoisting device forcefully retracts the cable and supports the differential. The hoisting device has a vertical adjustment system where the length of the extracted cable is adjusted whereby adjusting the height of the differential with respect to the axis 40. Thereafter, if necessary the hoisting assembly 20 and the differential 50 are repositioned in the longitudinal direction in a matter as shown in FIG. 6 whereby the connection locations of the differential are substantially aligned with the connection locations of the axle 40. Thereafter, as shown in FIG. 5 fasteners such as bolts 48 are inserted.

It should be noted that in some forms there are two differentials on a truck which would be referred to as a front differential and a rearward differential. Of course the hoisting assembly 20 is adapted and well-suited to remove and replace either front or rear differentials were either are referred to as differentials.

Of course various modifications and changes can be made without departing from the scope of the invention. The invention is broadly defined and only limited by the limitations in the claims below.

I claim:

1. A hoisting assembly for supporting a differential of a vehicle having a frame comprising first and second longitudinally extending vehicle frame members each vehicle frame member comprising an upper surface, the vehicle having a differential that is adapted to be attached to an axle of the vehicle, the hoisting assembly comprising:

a) a liner central frame having first and second lateral ends and a central area, the central frame supported substantially at the upper surface of the first and second vehicle frame members, the central frame first and second lateral ends terminating with containment brackets extending at substantially 90 degrees downwardly configured to operatively maintain the central frame on the upper surface of the first and second vehicle frame members;

b) a hoisting device adapted to be mounted to the central area of the central frame, the hoisting device comprising an attachment member that is adapted to be mechanically attached to the differential of the vehicle;

c) whereas, the hoisting device is adapted to raise the attachment member vertically and the differential attached thereto and support the differential where the central frame is positioned substantially vertically above the differential and the hoisting assembly is adapted to be mounted to the frame of the vehicle.

2. The hoisting assembly as recited in claim 1 where the vehicle has a longitudinal axis indicating a longitudinal direction the hoisting assembly further comprising:

the hoisting assembly is operatively configured to reposition in the longitudinal direction with respect to the vehicle on the upper surface of the first and second vehicle frame members.

3. The hoisting assembly as recited in claim 2 where the hoisting device comprises a cable that is adapted to extend and retract from a frame housing of the hoisting device.

4. The hoisting assembly as recited in claim 3 where the hoisting device comprises a crank member that is adapted to retract the cable and elevate the differential.

5. The hoisting assembly as recited in claim 4 where the central frame has first and second longitudinally extending members that are located in the first and second lateral ends respectively.

6. The hoisting assembly as recited in claim 4 where the first and second containment brackets operatively positioned to maintain a position of the hoisting assembly in the lateral direction and operatively positioned to maintain the hoisting assembly so the first and second lateral ends of the central frame are supported on the first and second vehicle frame members when the hoisting assembly is repositioned in the longitudinal direction with respect to the vehicle on the upper surface of the first and second vehicle frame members.

7. The hoisting assembly as recited in claim 2 where the first and second containment brackets operatively positioned to maintain a position of the hoisting assembly in the lateral direction and operatively position to maintain the hoisting assembly so the first and second lateral ends of the central frame are supported on the first and second vehicle frame members when the hoisting assembly is repositioned in the longitudinal direction with respect to the vehicle on the upper surface of the first and second vehicle frame members.

8. The hoisting assembly as recited in claim 1 where the hoisting device is operatively configured to raise the differential where the differential is not directly under the hoisting device.

9. The hoisting assembly as recited in claim 8 where the differential is configured to operate and lift a differential when the hoisting device is within 40° from a vertical access from the location of the hoisting device when initially lifting the differential.

10. The hoisting assembly as recited in claim 9 where the hoisting device is operatively configured to reposition laterally with respect to the central frame.

11. The hoisting assembly as recited in claim 1 where the hoisting device is operatively configured to reposition laterally with respect to the central frame.

12. The hoisting assembly as recited in claim 1 where the attachment member is operatively configured to engage a recessed region of the differential.

13. The hoisting assembly as recited in claim 12 where the central frame has first and second longitudinally extending members that are located in the first and second lateral ends respectively.

14. The hoisting assembly as recited in claim 1 where the central frame has first and second longitudinally extending members that are located in the first and second lateral ends respectively.

* * * * *